US005153542A

United States Patent [19]

Tai et al.

[11] Patent Number: 5,153,542

[45] Date of Patent: Oct. 6, 1992

[54] MULTIDIELECTRIC MICROSTRIP FILTER

[75] Inventors: Lite D. Tai, Roselle; Michael W. Petersen, Elgin, both of Ill.

[73] Assignee: Motorola Inc., Schaumburg, Ill.

[21] Appl. No.: 710,643

[22] Filed: Jun. 5, 1991

[51] Int. Cl.[5] ..... H01P 1/203; H01P 3/08

[52] U.S. Cl. ..... 333/204; 333/246

[58] Field of Search ..... 333/202, 204, 205, 219, 333/222, 246, 238, 263

[56] References Cited

U.S. PATENT DOCUMENTS

| | | | |
|---|---|---|---|
| 2,922,968 | 1/1960 | Van Patten | 333/204 |
| 3,417,352 | 12/1968 | Waller | 333/204 |
| 3,566,315 | 2/1971 | Vinding | 333/204 |
| 3,662,294 | 5/1972 | Jacobs et al. | 333/202 X |
| 3,879,690 | 4/1975 | Golant et al. | 333/204 |

OTHER PUBLICATIONS

Syrett B. A.; "A Broad-Band Element for Microstrip Bias in Tuning Circuits", *IEEE Transactions on Microwave Theory and Techniques, vol. Mtt-28, No. 8, Aug. 1980, pp. 925-927.*

Instruction Manual for Super-Compact, Version 2.0 published by Compact Software, Inc., (1989) pp. 4-42, 4-219 through 4-221.

*Primary Examiner*—Eugene R. LaRoche
*Assistant Examiner*—Seung Ham
*Attorney, Agent, or Firm*—Douglas D. Fekete; Donald B. Southard

[57] ABSTRACT

A multidielectric electrical filter is adapted for passing a primary electrical signal at a first frequency while attenuating higher frequency signals, most notably harmonic spurs. The filter comprises an elongated transmission line and one or more radial pads overlying a first surface of a dielectric support opposite a ground plate. The support is formed of a first dielectric material to achieve a desired capacitive coupling between the pad and the ground plate effective to attenuate the higher frequency signals. The support further comprises a region underlying the transmission line and containing a second dielectric material having a dielectric constant distinct from the first material. Preferably, the region includes one or more slots containing air to minimize the capacitive coupling between the transmisison line and the ground plate and thereby reduce insertion loss of the primary signal that would otherwise lessen the power of the signal to the antenna.

12 Claims, 1 Drawing Sheet

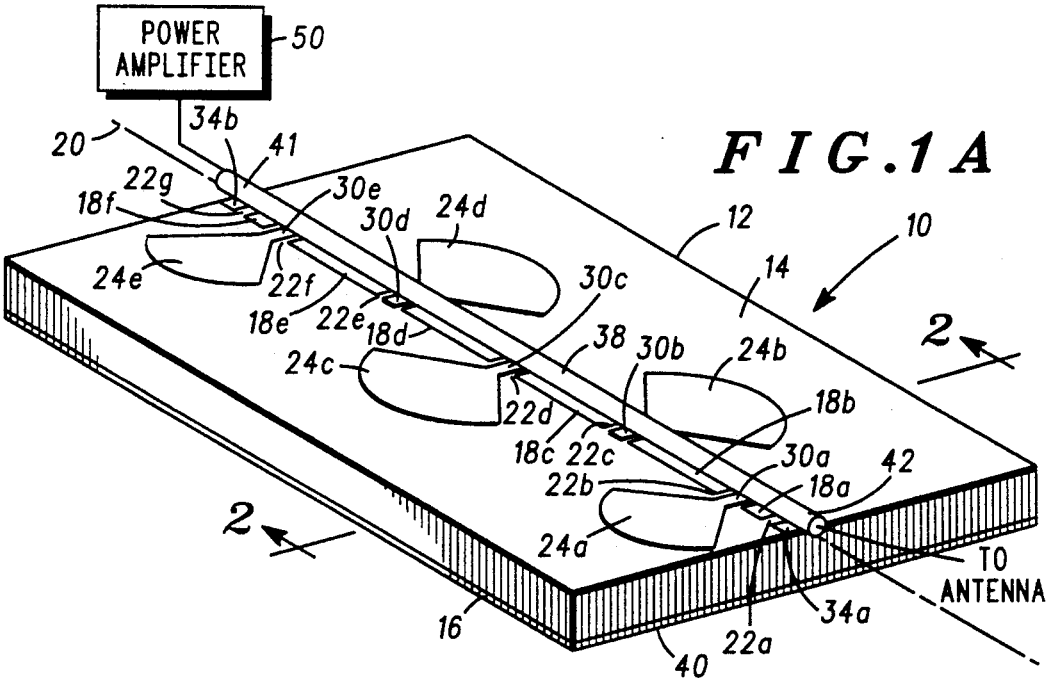
FIG.1A
FIG.1B
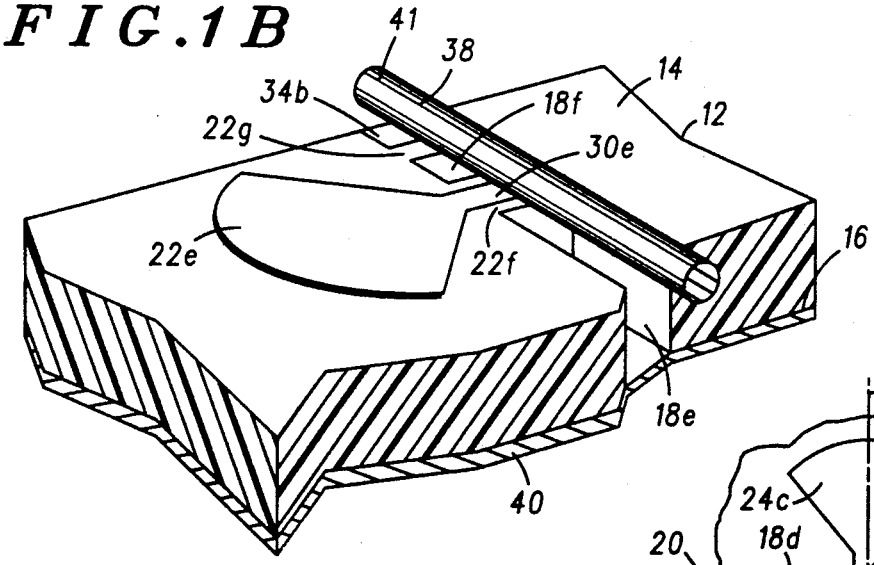
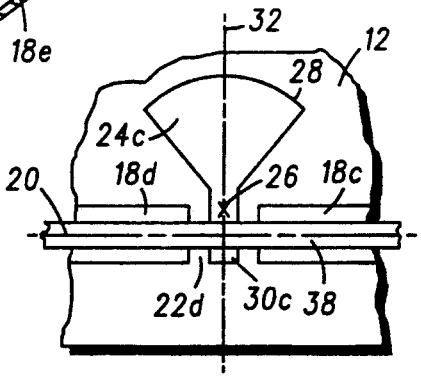
FIG.3
FIG.2
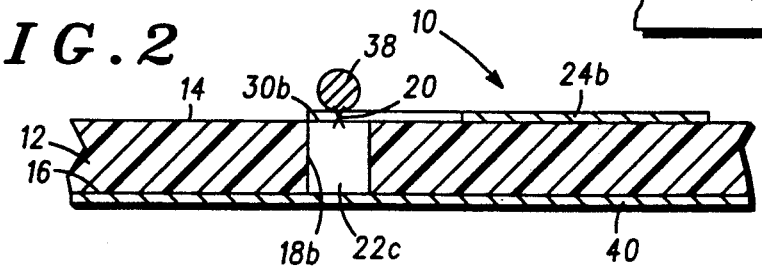

MULTIDIELECTRIC MICROSTRIP FILTER

BACKGROUND OF THE INVENTION

This invention relates to an electrical filter of the type employed to attenuate harmonic spurs prior to radio transmission. More particularly, this invention relates to a microstrip-type filter based upon a substrate that includes a first dielectric material to produce an optimum capacitive coupling between a radial pad for attenuation of the harmonic spurs and a second dielectric material underlying a transmission line to provide a distinct capacitive coupling with regard to the primary signal.

In a high power radio transmitter of the type employed in a base station of a communication system, an electrical signal is passed through a filter en route to the antenna for broadcast. The filter passes the primary signal of the desired broadcast frequency, while removing signals at higher frequencies, most notably signals at harmonic frequencies, referred to as harmonic spurs. For this purpose, it is desired to minimize insertion loss of the primary signal while maximizing attenuation of the harmonic spurs.

A conventional high power filter comprises a wire transmission line along a central axis of a cylindrical metal housing. The transmission line is connected to a series of circular metal plates that perpendicularly intersect the line. The plates are circumferentially spaced apart from the housing, which is grounded, by a dielectric material to create a capacitive coupling effective to shunt the harmonic spurs. Such filters have been generally satisfactory for suppressing harmonic spurs, but are massive in construction and expensive.

Microstrip filters are known that comprise a transmission line and intersecting pads affixed to a surface of a dielectric board opposite a ground plate. The resonator pads are capacitively coupled to the ground plate and sized and located along the transmission line to attenuate the harmonic spurs. Microstrip filters have been generally suitable for low power transmissions, but suffer from a high insertion loss that reduces the power of the primary signal and is not desirable for high power transmissions.

SUMMARY OF THE INVENTION

This invention contemplates an electrical filter comprising an elongated transmission line and one or more radial pads overlying a first surface of a dielectric support opposite a ground plate. The support is formed of a first dielectric material to achieve a desired capacitive coupling between the pad and the ground plate effective for attenuating harmonic spurs. The support further comprises a region underlying the transmission line and containing a second dielectric material having a dielectric constant distinct from the first material to modify the capacitive coupling between the primary signal carried by the transmission line and the ground plate. Preferably, the second material is selected that reduces the capacitive coupling and further exhibits a low loss tangent relative to the first material, and thereby minimizes insertion loss of the primary signal.

In one aspect of this invention, this invention contemplates a radio broadcast system comprising the electrical filter operatively connected to a power amplifier and the antenna for attenuating harmonic spurs while passing the primary signal with minimal insertion loss.

In a preferred embodiment, a multidielectric electrical filter of this invention comprises the dielectric board having opposite upper and lower major surfaces. A transmission line is mounted to the board upper surface and includes an input end and an output end. The filter further comprises one or more radical pads affixed to the board upper surface and laterally disposed relative to the transmission line. Each pad is electrically connected to the line spaced apart from the conductor ends. The size, shape and location of the one or more pads are selected to optimize attenuation of signals at harmonic frequencies above the primary signal. The filter also includes an electrical ground plate affixed to the lower substrate surface opposite the transmission line and the pad. In accordance with this invention, the board is formed of a solid material having a dielectric constant greater than air and disposed intermediate the pad and the ground plate to produce a desired capacitive coupling effective for harmonic frequency attenuation. The board also defines a channel underlying the transmission line, which contains a second dielectric material having electrical properties distinct from the first material. Preferably, the channel forms an air space between the transmission line and the ground plate. The air features a low dielectric constant to reduce capacitive coupling between the transmission line and the ground plate. Furthermore, the air exhibits a minimal loss tangent to reduce conduction and thermal losses due to induced current. As a result, the preferred filter of this invention reduces transmission loss of the primary signal through the transmission line, which would otherwise reduce the strength of the signal supplied to the antenna. Nevertheless, the filter provides effective attenuation of the harmonic spurs. This combination is particularly advantageous for high power radio transmitters. In addition, the electrical filter features a relatively simple microstrip construction comprising elements attached to a board surface and is relatively inexpensive to manufacture, particularly in comparison to conventional high power coaxial filters.

BRIEF DESCRIPTION OF THE DRAWINGS

This invention will be further described with reference to the drawings wherein:

FIG. 1A is a perspective view of an electric filter in accordance with this invention;

FIG. 1B is an enlarged view of an end portion of the filter in FIG. 1A:

FIG. 2 is a cross sectional view of the filter in FIG. 1 taken along the line 2—2 in the direction of the arrows; and FIG. 3 is an elevational view of a portion of the filter in FIG. 1A showing a radial pad.

DETAILED DESCRIPTION OF THE INVENTION

In a preferred embodiment, referring to the figures, a multidielectric electrical filter 10 in accordance with this invention is adopted for transmitting a high power electrical signal on the order of about 300 watts and having a predetermined frequency within a range about 900 MHz. The filter passes relatively low frequency signals, including the primary signal, while attenuating high frequency signals, including harmonic signals that accompany the primary signal at integer multiples of the primary frequency. Thus, high power, low pass filter 10 is particularly well suited for filtering signals for radio broadcast purposes, for example, in a base station of a land-mobile communications system.

Filter 10 comprises a dielectric board 12 having opposite, planar upper and lower surfaces 14 and 16, respectively. Board 12 is composed of a glass fiber-reinforced polymeric material, such as polytetrafluroethylene polymer or the like, having a dielectric constant of about 2.55. In accordance with this invention, board 12 defines a series of slots 18*a–f* that extend between surfaces 14 and 16 aligned along an axis 20 parallel to upper surface 14 and are separated by partitions 22*a–g* that are part of the board material.

Affixed to upper surface 14 is a series of radial pads 24*a–e* formed of metallic copper plated onto surface 14. As illustrated in FIG. 3 for central pad 24*c*, each pad is formed in a fan-shaped pattern symmetrical about centerline 32 and having an apex 26 proximate to axis 20 and an accurate edge 28 remote from the axis at a constant radius from apex 26. Each pad 24*a–e* is located adjacent a corresponding partition 22 and includes an extension 30*a–e* onto the partition. In the illustrated arrangement, pad 24*c* intersects axis 20 at a midpoint equidistant from the ends of board 12 and extends in a first direction. Pads 24*b* and 24*d* intersect axis 20 equidistant about center pad 24*c* and extend in a direction opposite pad 24*c*, whereas pads 24*a* and 24*e* are also disposed equidistant about center pad 24*c*, but extend in the direction of pad 24*c*. This provides a symmetrical, compact arrangement of the pads on surface 14. Surface 14 also carries copper plated end pads 34*a* and 34*b* overlying end partitions 22*a* and 22*g*.

Filter 10 further comprises a nickel-clad copper wire transmission line 38 axially mounted onto board surface 14 and affixed by solder bonds to each extension 30*a–e* and each end pad 34*a* and 34*b*. The solder bonds not only physically attach line 38 to board 12, but also provide electrical connections between the line and pads 24*a–e*. Line 38 includes an input end 41 and an output end 42. The diameter of wire 38 is sized small relative to the width of slots 18*a–f*, so that the slots extend laterally about the wire for communication with ambient atmosphere.

A copper plate 40 is affixed to board lower surface 16 and is adapted for electrical connection to ground potential. Ground plate 40 is coextensive with the lower board surface and extends to close the lower openings of slots 18. Thus, ground plate 40 is disposed opposite pads 24 spaced apart by dielectric board 12 to provide a first capacitive coupling therebetween. Furthermore, ground plate 40 is disposed opposite transmission line 38 and, except at partitions 22, is spaced apart by air within slots 18 to provide a reduced capacitive coupling therebetween.

For operation, filter 10 is incorporated into a radio base station with inlet 41 of transmission line 38 operatively coupled to a power amplifier 50 that generates a high power electrical signal at a predetermined frequency within a range about 900 MHz for broadcast, as well as one or more harmonic secondary signals. Output end 42 of transmission line 38 is operatively connected to an antenna. As the signals are transmitted through wire 38, the pads 24 cooperate with ground plate 40 to form a capacitive shunt for attenuating the high frequency spurs. However, the primary frequency signal is passed with reduced insertion loss. This is attributed in large part to the low dielectric constant and the low loss tangent of the air within slots 18. This reduces the capacitive coupling between line 38 and the ground plate 40. In addition, the lower dielectric constant extends the effective wavelength of the signal through filter 10 to increase the uppermost frequency at which the filter becomes ineffective for attenuating signals, referred to as the flyback frequency, to provide harmonic suppression over a greater frequency range. As a result, filter 10 provides more efficient transmission at the primary frequency, and provides more effective filtering over the expanded high frequency range. This is accomplished by a filter 10 having a relative simple microstrip construction, particularly in comparison to conventional coaxial filters.

In the described embodiment, the filter comprises a series of five radial pads symmetrically disposed along the transmission line. The specific performance characteristic of the filter depends upon the combination of several factors in accordance with well known principles, including the nature and thickness of the dielectric material forming the board, the thickness of the copper plate forming the pad, the location and shape of the pads, the size of the transmission line, and the characteristics of the electrical signals applied to the filter. It is believed that conventional methods may be employed to calculate pad size and placement for a particular application, while obtaining the benefits of a reduced insertion loss due to the air spaces underlying the transmission line in accordance with the preferred embodiment of this invention.

In the described embodiment, the filter comprises a dielectric polymer composite underlying the pads and a second dielectric, e.g., air, underlying the majority of the transmission line and having low dielectric properties that are advantageous for minimizing insertion loss and is preferred. Alternately, the slots may contain a gas other than air, such as nitrogen or a noble gas. Furthermore, this invention may be suitably adapted utilizing a second dielectric other than a gas. Thus, the slots may be suitably filled with a second polymer having a dielectric constant distinct from the board polymer. The slots may be filled following construction of the resonator pads and mounting of the wire to the board. Alternately, the slots may be filled prior to forming the pads or affixing the transmission line. Thus, in an alternate embodiment, the board may comprise a continuous channel that is filled with a second material, such as a polymeric material, that cooperates with the board to provide a continuous planar upper surface to which the pad and transmission wire is affixed, thereby eliminating the intermittent partitions in the described embodiment for supporting the pad extensions. Furthermore, the transmission line may be suitably formed of a copper plate applied to the surface of the channel material, as opposed to a preformed wire. While this invention is particularly well suited for providing a material having a low tangent loss and a reduced capacitive coupling underlying the transmission line, this invention may be adapted to provide a distinct dielectric material having a relatively higher loss tangent and producing a relatively higher capacitive coupling with the transmission line for providing insertion loss characteristics that are optimum for a particular application.

While this invention has been described in terms of certain embodiments thereof, it is not intended that it be limited to the above description but rather only to the extent set forth in the claims that follow.

The embodiments of the invention in which an exclusive property or privilege is claimed are defined as follows:

1. A multidielectric electrical filter comprising:

a dielectric support having opposite upper and lower major surfaces and including a first region and a second region, an elongated transmission line overlying the second region adjacent to the support upper surface and having an input end and an output end, at least one radial pad overlying the first region of said support at the upper surface, said pad being disposed laterally of said transmission line and having an electrical connection to said transmission line spaced apart from said ends, an electrical ground plate adjacent to the support lower surface opposite from the transmission line and the pad, said first region of said support being formed of a solid first material having a first dielectric constant and disposed between the pad and the ground plate to produce a desired capacitive coupling therebetween, said second region of said support comprising a second material having a second dielectric constant distinct from the first dielectric constant and underlying the transmission line to produce a modified capacitive coupling between the transmission line and the ground plate.

2. An electrical filter in accordance with claim 1 wherein the second material is air and the first material has a dielectric constant greater than air.

3. A multidielectric high power, low pass electrical filter comprising:

a dielectric board having opposite upper and lower major planar surfaces and an axis parallel to the upper surface, an electrically conductive wire axially affixed to the board upper surface and having an input end and an output end, at least one radial pad affixed to said board upper surface, said pad having an apex proximate to said axis and an electrical connection to the wire spaced apart from the wire ends, said pad being symmetrical about a centerline normal to the axis, an electrical conductive ground plate affixed to the board lower surface opposite from the wire and the pad, said board being formed of a solid material having a dielectric constant greater than air and disposed between the pad and the ground plate to produce a desired capacitive coupling therebetween, said board further defining axial channels underlying the wire and extending between said wire ends and the electrical connection to provide an air space between the wire and the ground plate to reduce capacitive coupling therebetween.

4. A filter in accordance with claim 3 further comprising at least two pads having electrical connections to the wire spaced apart along said axis and defining centerlines extending in opposite directions relative to the axis.

5. A filter in accordance with claim 3 wherein the wire has a midpoint equidistant from said ends, and wherein the filter comprises a first said pad having an apex connection at said midpoint and a said centerline extending in a first direction from said axis and further comprises at least two said pads having apex connections symmetrical about the midpoint and extending in a direction opposite said first direction.

6. A multidielectric high power, low pass electrical filter for passing an oscillating electrical signal at a first frequency and attenuating electrical signals at relatively higher frequencies, comprising:

a dielectric board having opposite upper and lower major planar surfaces and having an axis parallel to the upper surface, an electrically conductive wire axially mounted onto the board upper surface and having an input end and an output end, at least one electrically conductive radial pad affixed on said board upper surface and having an apex proximate to said axis but spaced apart therefrom, said pad including an extension underlying the wire and electrically connected thereto, said pad extending generally laterally of said wire, an electrical ground plate affixed to the board lower surface opposite the wire and the radial pad, said board being formed of a solid material having a dielectric constant greater than air and disposed between the radial pad and the ground plate to produce a desired capacitive coupling suitable for attenuating the higher frequency signals, said board further defining axial channels underlying said wire between said ends and said pad extension to provide an air space separating the wire and thereby reduce insertion loss of the first frequency signal.

7. In a radio broadcast system comprising a power amplifier and an antenna, said power amplifier having an output and adapted for producing a primary alternating electrical signal having a predetermined frequency, said power amplifier further producing electrical signals at relatively higher frequencies that are cotransmitted with said primary signal, said antenna having an input for accepting an electrical signal and adapted for broadcasting a radio signal based upon the electrical signal, a filter having an input operatively coupled to the power amplifier output and an output operatively coupled to the antenna input and adapted for passing the primary signal and attenuating the higher frequency signals, said filter comprising:

a dielectric support having opposite upper and lower major surfaces, an elongated transmission line adjacent to the support upper surface and having an input end corresponding to the filter input and an output end corresponding to the filter output, at least one radial pad overlying a region of said support upper surface, said pad being disposed laterally of said transmission line and having an electrical connection to said transmission line spaced apart from said ends, an electrical ground plate adjacent to the support lower surface opposite the transmission line and the pad, said support being formed of a solid first material having a first dielectric constant and disposed between the pad and the ground plate to produce a desired capacitive coupling therebetween, said support further comprising a second material having a second dielectric constant distinct from the first dielectric constant and underlying at least a portion of the transmission line between the transmission line ends and the pad connection, said second material extending between the transmission line and the ground plate to produce a reduced capacitive coupling therebetween.

8. A radio broadcast system in accordance with claim 7 wherein the second material is air and the first material has a dielectric constant greater than air.

9. In a radio broadcast system comprising a power amplifier and an antenna, said power amplifier having an output and adapted for producing a primary alternating electrical signal having a predetermined frequency, said power amplifier further producing electrical signals at relatively higher frequencies that are cotransmitted with said primary signal, said antenna having an input for accepting an electrical signal and adapted for broadcasting a radio signal based upon the electrical signal, a filter having an input operatively coupled to the power amplifier output and an output operatively coupled to the antenna input and adapted for passing the primary signal and attenuating the higher frequency signals, said filter comprising a dielectric board having opposite upper and lower major planar surfaces and an axis parallel to the upper surface, an electrically conductive wire axially affixed to the board upper surface and having an input end corresponding to the filter input and an output end corresponding to the filter output, at least one radial pad affixed to said board upper surface, said pad having an apex proximate to said axis and an electrical connection to the wire spaced apart from the wire ends, said pad being symmetrical about a centerline normal to the axis, an electrical conductive ground plate affixed to the board lower surface opposite the wire and the pad, said board being formed of a solid material having a dielectric constant greater than air and disposed between the pad and the ground plate to produce a desired capacitive coupling effective for shunting said higher frequency signals, said board further defining axial channels underlying the wire and extending between said wire ends and the pad connection to provide an air space between the wire and the ground plate to reduce capacitive coupling therebetween and thereby reduce insertion loss of the primary signal.

10. A radio broadcast system in accordance with claim 9 wherein the filter further comprises at least two said pads having electrical connections to the wire spaced apart along said axis and defining centerlines extending in opposite directions relative to the axis.

11. A radio broadcast system in accordance with claim 9 wherein the filter comprises the wire has a midpoint equidistant from said ends, a first said pad having an apex connection at said midpoint and a centerline extending in a first direction from said axis and at least two said pads having apex connections symmetrical about the wire midpoint and extending in a direction opposite said first direction.

12. A radio broadcast system comprising a power amplifier and an antenna, said power amplifier having an output and adapted for producing a primary alternating electrical signal having a predetermined frequency, said power amplifier further producing electrical signals at relatively higher frequencies that are cotransmitted with said primary signal, said antenna having an input for accepting an electrical signal and adapted for broadcasting a radio signal based upon the electrical signal, a filter having an input operatively coupled to the power amplifier output and an output operatively coupled to the antenna input and adapted for passing the primary signal and attenuating the higher frequency signals, said filter comprising a dielectric board having opposite upper and lower major planar surfaces and having an axis parallel to the upper surface, an electrically conductive wire axially mounted onto the board upper surface and having an input end corresponding to the filter input and an output end corresponding to the filter output, at least one electrically conductive radial pad affixed on said board upper surface and having an apex proximate to said axis but spaced apart therefrom, said pad including an extension underlying the wire and electrically connected thereto, said pad extending generally laterally of said wire, an electrical ground plate affixed to the substrate lower surface opposite the wire and the radial pad, said board being formed of a solid material having a dielectric constant greater than air and disposed between the radial pad and the ground plate to produce a desired capacitive coupling effective for attenuating the higher frequency signals, said board further defining axial channels underlying said wire between said ends and said pad extension to provide an air space separating the wire and thereby minimize insertion loss of the primary signal.

* * * * *